United States Patent [19]

Sakasegawa et al.

[11] 4,011,112

[45] Mar. 8, 1977

[54] MULTI-SECTIONED COOLING METHOD FOR HEATED STEEL MATERIAL

[75] Inventors: Koji Sakasegawa, Fukuyama; Kazuo Kunioka, Yokohama; Atushi Ohsumi, Fukuyama, all of Japan

[73] Assignee: Nippon Kokan Kabushiki Kaisha, Tokyo, Japan

[22] Filed: May 28, 1974

[21] Appl. No.: 473,825

[30] Foreign Application Priority Data

June 8, 1973 Japan ..... 48-63921

[52] U.S. Cl. ..... 148/134; 62/64; 148/153; 148/155; 148/157

[51] Int. Cl.[2] ..... C21D 1/18

[58] Field of Search ..... 148/143, 145, 153, 156, 148/157, 155, 134; 62/62, 64

[56] References Cited

UNITED STATES PATENTS

| | | | |
|---|---|---|---|
| 1,178,352 | 4/1916 | Sandberg | 148/157 |
| 3,533,261 | 10/1970 | Hollander et al. | 148/157 |
| 3,546,911 | 12/1970 | Lenz | 148/155 |

*Primary Examiner*—R. Dean
*Attorney, Agent, or Firm*—Flynn & Frishauf

[57] ABSTRACT

Heated steel material which is to be cooled is multi-sectioned in the longitudinal direction of said material into n zones. Spaced apart zones of the n zones are individually cooled, and then the material is finally cooled as a whole.

13 Claims, 14 Drawing Figures

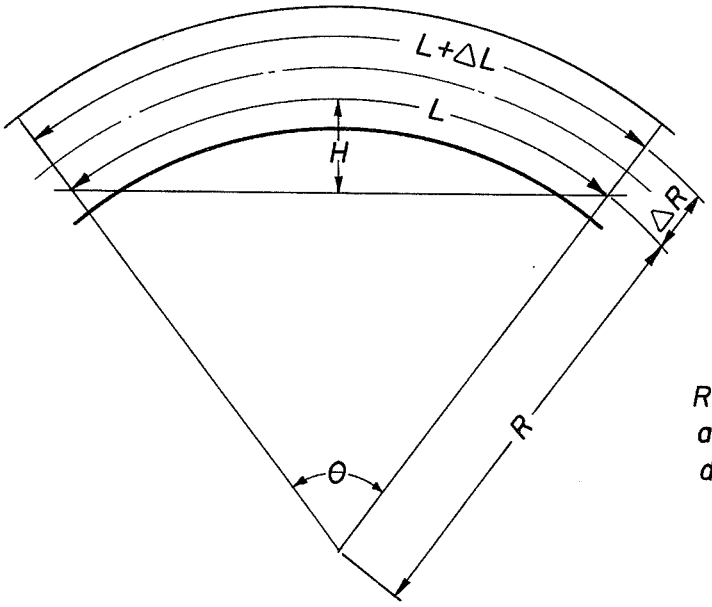
FIG. 1
Relation between amount of plastic deformation and curve
PRIOR ART
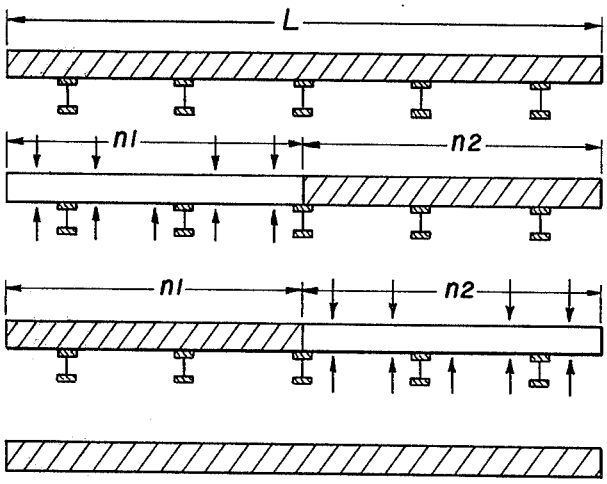
FIG. 2(a)
FIG. 2(b)
FIG. 2(c)
FIG. 2(d)
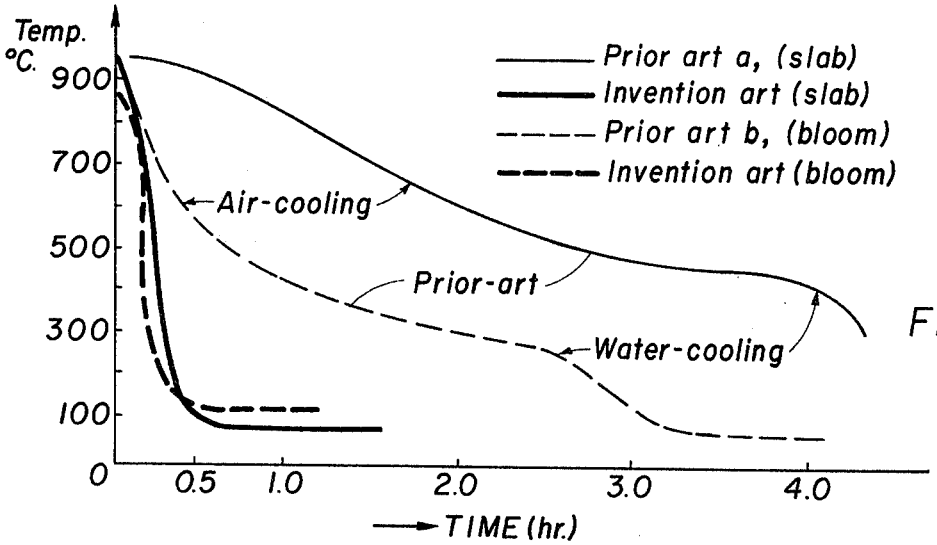
FIG. 5

Chain type System
Skid type System

L
n1
n2
n3
n4
n5
n6
n7
1
2
3
4
5
6
7
8
9
21
31
41
81
91

MULTI-SECTIONED COOLING METHOD FOR HEATED STEEL MATERIAL

The present invention relates to an improved method of forcibly cooling a heated steel material while causing little deforming of the material after cooling.

When cooling heated steel materials, e.g. billets, blooms, slabs or long length material, no deformation will take place if the cooling of the material is performed uniformly as a whole. However, such uniform cooling is hard to achieve in actual practice, and consequently, large deformation is known to take place.

As is known, the support members for heated steel material, such as skids, which are arranged on the cooling floor, cause said deformation. That is, it is extremely difficult to cool the portion of the heated steel material contacting with said skid so that the local temperature at the contacting portion becomes higher than the local temperature at other sections, which in turn causes some plastic deformation due to an unbalance of thermal stress.

Such deformation naturally presented various difficulties in the operational processes after the cooling step. Therefore, this encouraged many proposals to obviate this particular problem. Representative examples of such proposals are step-wise cooling for a heated steel material, use of a truck rail with narrower skid, or use of a roller table. However, all these prior proposals, without exception, are expensive to implement and yet are low in efficiency. Thus, there are many difficulties to be worked out in the prior art forced cooling methods for a heated steel material.

The main object of this invention is to provide a method of cooling a heated steel material with little deformation so that it is possible to carry out subsequent processes on the cooled steel material with little difficulty.

SUMMARY OF THE INVENTION

The present invention is characterized in that the heated steel material subjected to cooling is multi-sectioned into a plurality of zones in the longitudinal direction. Spaced apart zones are cooled individually first and then the material is cooled as a whole.

BRIEF DESCRIPTION OF THE DRAWINGS

FIG. 1 shows a relation between the amount of plastic deformation of a heated steel material and curve thereof;

FIGS. 2(*a*)–2(*d*) illustrate a prior fundamental cooling system wherein the material is sectioned into 2 adjacent zones in the longitudinal direction of a heated steel material;

FIGS. 4(*a*)–4(*d*) illustrate another typical multi-sectioned cooling system of the present invention wherein chains are employed; and FIG. 5 is a graph illustrating cooling time vs. temperature for the present invention and for the prior art.

DETAILED DESCRIPTION OF THE DRAWINGS

Figures 3, 4A, 4B, 4C, 4D:
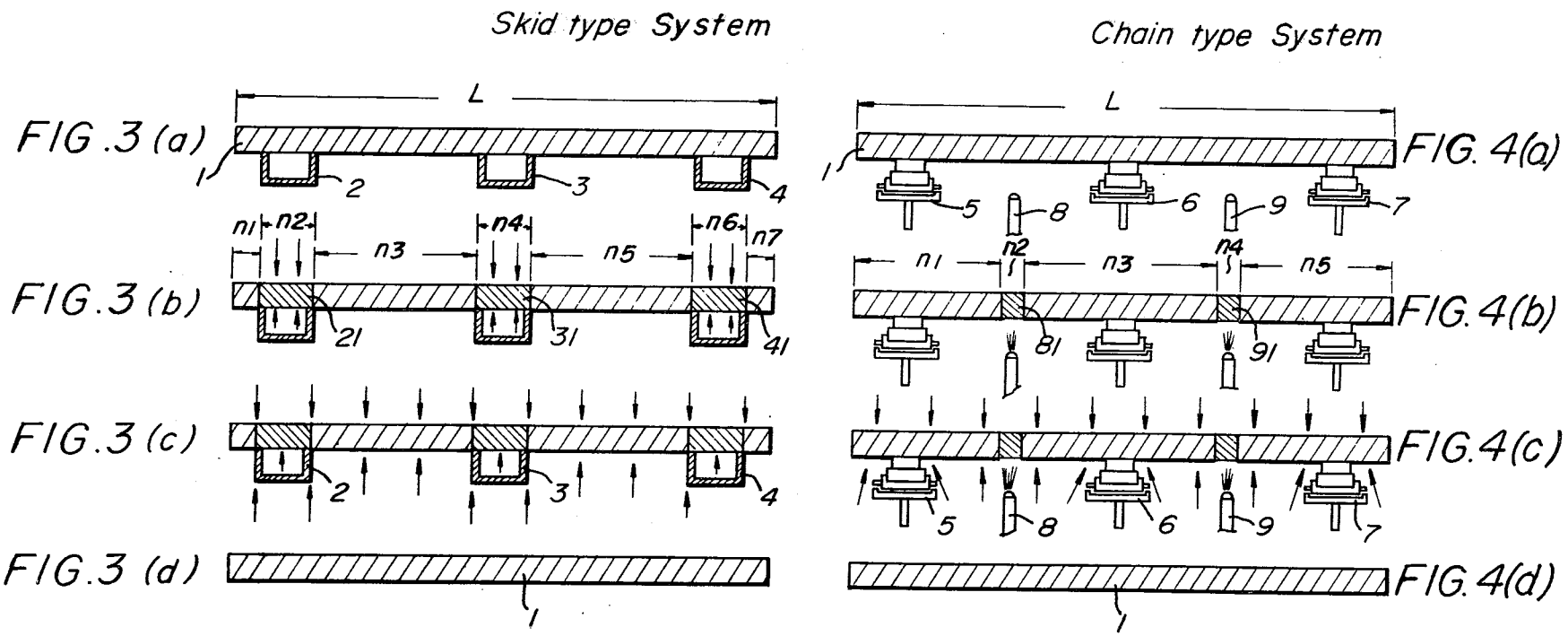
FIGS. 3(*a*)–3(*d*) illustrate a typical multi-sectioned cooling system of the present invention wherein special type skids are employed.

The present invention is based on the fact that amount of plastic deformation H of a heated steel material which is cooled is proportionate to the square of the length L of the steel material. This fact has been confirmed through numerous experiments conducted on the plastic deformation caused by unbalance of thermal stress brought about by the varying degree of cooling effects on the top and the bottom surfaces of said material. To summarize the results obtained, the plastic deformation H becomes smaller as the length L becomes shorter. FIG. 1 in the accompanying drawings shows diagrammatically the relation mentioned above. In FIG. 1:

$\epsilon$ = degree of plastic deformation caused at high temperature;

R = radius of curvature;

L = length of material; and $2\Delta R$ = thickness of material.

It is clear that the following relation is obtained geometrically:

$$\frac{L+\Delta L}{L}=\frac{R+\Delta R}{R}\ \theta=\frac{L}{R}\ \epsilon=\frac{\Delta L}{L}=\frac{\Delta R}{R}$$

Therefore, the amount of deformation H actually caused is, $$H=R\,(1-\cos\theta/2)$$

$$=\frac{\Delta R}{\epsilon}\left(1-\cos\frac{L\epsilon}{2\Delta R}\right)\div\frac{\Delta R}{\epsilon}\,2\,\mathrm{Sin}^2\frac{L\epsilon}{4\Delta R}\ (\mathrm{Sin}\ \theta\div O)$$

$$=\frac{\Delta R}{\epsilon}\,2\left(\frac{L\epsilon}{4\Delta R}\right)^2=\frac{L^2\epsilon}{8\Delta R}$$

Thus, if the heated steel material having a length $\tau$ was to be multi-sectioned into n zones in its longitudinal direction, and the zones thus sectioned were to be cooled individually, the resulting deformation will greatly decrease. In this case, the larger the number n, the greater the decrease will become.

In FIGS. 2(*a*)–2(*d*), a process for individually cooling a steel strip sectioned into two zones is shown. This process has been disclosed in Japanese Patent Application No. 115727/70 as a fundamental cooling system, namely, a process of individually cooling zone $n_1$ and $n_2$, and bringing about the effects of decreasing deformation.

As shown in FIG. 2(*a*), a heated steel material is placed on the skids. Subsequently, the zone $n_1$ is cooled as shown in FIG. 2(*b*) and then the zone $n_2$ is cooled as shown in FIG. 2(*c*). If necessary, the material is finally cooled as a whole. This cooling system shows little deformation of the material as seen in FIG. 2(*d*).

However, it was learned in carrying out the actual operation that simply sectioning the heated steel material into two adjacent zones, as in the system illustrated in FIGS. 2(*a*)–(*d*), was not sufficient in the case where the material became longer in length. Accordingly, the present invention proposes the multi-sectioning of said heated steel material into *n* zones in the longitudinal direction. Such multi-sectioning into n zones is preferably carried out by taking into consideration the support members of the heated steel material. FIGS. 3(*a*)–(*c*) show a cooling system of the present invention with skid type support members for the heated material, and FIGS. 4(*a*)–(*c*) show a cooling system of the present invention with chain type support members.

In FIG. 3(*a*) the heated steel material of length L is multi-sectioned by the skids 2, 3, and 4 into seven zones, $n_1$ to $n_7$. In this type cooling system, the material 1 is placed on the skids 2, 3 and 4 in the step shown in FIG. 3(*a*). Then the material is cooled at the portions (zones $n_2$, $n_4$ and $n_6$) which contact with the skid from the bottom side, or from both the top and the bottom sides, with water or with other known cooling agents to form cooled sections 21, 31, and 41 as shown in FIG. 3(*b*).

In the FIG. 3 embodiment, a channel-type member or a member in which a hollow is formed in the center or the like is preferably employed as the skid members 2, 3, and 4. With this type of arrangement, the contact portion of the material 1 with the respective skids, becomes a hole and a gap is formed between the central portion of the skid and the material as seen in FIGS. 3(*b*) and 3(*c*). The cooling of the material 1 is first carried out on the bottom side facing the hollow in the skid by spraying a cooling agent through the hollow, as indicated by the arrows in FIG. 3(*b*). Such local cooling produces cold sections or narrow bands 21, 31 and 41. The resultant cooled narrow bands 21, 31 and 41 are formed in the transverse direction of the material 1. One example of the type of skid illustrated in FIGS. 3(*a*)–3(*c*) is disclosed in Japanese Patent application No. 74789/71 (U.S. Pat. Application Ser. No. 341,063). Next as shown in FIG. 3(*c*), the steel strip is cooled as a whole. Upon completion of cooling as shown in FIG. 3(*c*), the material 1 shows little deformation, e.g. curve, and presents no problem or difficulty in carrying out subsequent operations on the cooled steel strip. It is preferable in actual operation that both the bottom of the strip facing the hollow in the skid and the top of the strip opposite to said hollow are cooled simultaneously, as illustrated by the arrows in FIG. 3(*b*).

FIGS. 4(*a*)–4(*c*) show a chain type cooling system according to the present invention wherein the material 1 is supported by chains 5, 6 and 7, and is multi-sectioned into five zones $n_1$ to $n_5$ by the spray nozzles 8 and 9 arranged for cooling purposes. As is the case with the skid type system discussed above, a heated steel material 1 placed on chains 5, 6, and 7 as shown in FIG. 4(*a*), is multi-sectioned by the arranged spray nozzles 8 and 9 into five zones $n_1$ to $n_5$. The material 1 is first cooled by the spraying of a cooling agent (i.e., water or other known cooling agent) on the bottom side facing said nozzles, FIG. 4(*b*). In such a case, it is preferable in actual operation that also the top side of the strip which is opposite to said nozzle as well as said bottom side are cooled simultaneously. The resultant cold spots or cooled narrow bands 81 and 91 (zones $n_2$ and $n_4$) are formed in the transverse direction of said material 1. After this step, the material 1 is cooled as a whole as illustrated schematically by the arrows in FIG. 4(*c*). Material cooled in this manner shows little deformation, as seen in FIG. 4(*d*).

The details of typical examples of the cooling method according to the present invention is given in the table below, in which the n-sectioned pitch is about 1000 mm, and:

in FIG. 3

$n_3$ and $n_5$ each equal about 800 mm; $n_2$, $n_4$ and $n_6$ each equal about 200 mm; and $n_1$ and $n_7$ are remainders; and in FIG. 4

$n_3$ is about 800 mm; $n_2$ and $n_4$ each equal about 200 mm; and $n_1$ and $n_5$ are remainders.

The above values are approximate and may vary.

| | | Slab A | Bloom B | Bloom C |
|---|---|---|---|---|
| Dimensions of material (mm) | | 215 thick × 1,050 wide × 8,900 long | 220 thick × 270 wide × 10,000 long | 200 thick × 250 wide × 10,000 long |
| Initial temperature of materials (° C) | | 950 – 1000 | 950 – 1000 | 950 – 1000 |
| Temperature after cooling (° C) | | < 100 | < 150 | < 150 |
| cooling times (minutes) | | 24 | 18 | 18 |
| Volume of cooling water [l/(min · M²)] | top side | 19 | 20 | 20 |
| | bottom side | 23 | 55 | 55 |
| | skid portion | 52 | 48 | 48 |

FIG. 5 shows the temperature vs. cooling time characteristics for a prior art air-cooling method and for the method of the present invention. This Figure demonstrates the prominent improvement provided by the present invention.

Thus, it has been found that it is feasible to form cooled narrow bands based on cold spots in the transverse direction by the L/n cooling method, the cooled narrow bands being spaced in the longitudinal direction of the heated steel material, and to then cool the material as a whole. This method of the present invention prevents a heated steel material from being subjected to an unbalance of thermal stress in the forcible cooling thereof. Any number of zones (and consequently cooled narrow bands) could be used, depending upon the length L of the strip being cooled.

The multi-section cooling method of the present invention is very effective as a forced cooling method for long length steel material such as billets, blooms or slabs and as a method showing little deformation of the cooled strip. Further, the method of the present invention is much more efficient and lower in cost as compared to the conventional step-wise cooling methods, or those using rotating table or truck rails. No special plant facilities are required for the present invention.

The present invention is further advantageous in that the control of the cooling water or other cooling agent for a heated steel material is comparatively easy. Other advantages of the present invention are that the yield is improved due to decreasing the deformation of the steel materials and that labor is saved by virtue of facilitating continuous cooling. Thus, the present invention for the first time in the art offers a forced cooling of heated steel materials without provision of any special plant facilities and without any of the difficulties which were hitherto unavoidable.

We claim:

1. A method for forcibly cooling an elongated heated steel material of predetermined length by cooling means, the heated steel material being maintained stationary relative to said cooling means at least in the longitudinal direction of said heated steel material, comprising:

multi-sectioning said elongated steel material in the longitudinal direction thereof into a plurality of zones;

cooling only a plurality of zones in said steel material which are spaced apart from each other by uncooled zones in the longitudinal direction of said steel material while maintaining said steel material stationary relative to said cooling means; and thereafter cooling said steel material as a whole.

2. The method according to claim 1 wherein alternate zones of said plurality of zones are cooled during said first cooling step.

3. The method according to claim 1 wherein said first cooling step comprises cooling only one surface of said spaced zones.

4. The method according to claim 1 wherein said first cooling step comprises simultaneously cooling opposing surfaces of said spaced zones.

5. The method according to claim 1 wherein said plurality of zones cooled in said first cooling step are narrow transverse bands which are substantially narrower than the remaining zones.

6. The method according to claim 1 wherein said steel material is multi-sectioned into said plurality of zones by arranging a plurality of spaced apart skids and locating said steel material on said skids with each of said skids being arranged substantially in the transverse direction of said material.

7. The method according to claim 6 wherein the portions of said material on respective skids comprise said spaced apart zones which are cooled in said first cooling step.

8. The method according to claim 7 wherein said skids have hollows in the central portions thereof and the spaced apart zones cooled in said first cooling step are the bottom portions of said material facing said hollows.

9. The method according to claim 8 comprising spraying a cooling agent from the hollows in said skids to cool the bottom side of said material in said first cooling step to form spaced cooled narrow bands in the transverse direction of said material.

10. The method according to claim 8 comprising simultaneously cooling the bottom side of said material facing the hollows and the top side of said material opposite to said hollows during said first cooling step.

11. The method according to claim 1 wherein said steel material is multi-sectioned into said plurality of zones by arranging a plurality of spaced apart spray nozzle means and locating said steel material adjacent said spray nozzle means with respective spray nozzle means being oriented substantially in the transverse direction of said material.

12. The method according to claim 11 comprising spraying a cooling agent on the bottom side of said material at the portions thereof facing said nozzle means during said first cooling step to form spaced cooled narrow bands in the transverse direction of said material.

13. The method according to claim 12 comprising simultaneously cooling the bottom side of said material facing said nozzle means and the top side of said material opposite to said nozzle means during said first cooling step.

* * * * *